United States Patent [19]

Takeda

[11] 4,430,777

[45] Feb. 14, 1984

[54] SOCKET COMPONENT FOR SNAP FASTENER

[76] Inventor: Tadashi Takeda, 12 Banchi, 1 Chome, Kita-Kinomoto, Yao-city, Osaka, Japan

[21] Appl. No.: 414,027

[22] Filed: Sep. 2, 1982

[30] Foreign Application Priority Data

Apr. 13, 1982 [JP] Japan ..... 57-54200[U]

[51] Int. Cl.[3] ..... A44B 17/00

[52] U.S. Cl. ..... 24/681

[58] Field of Search ..... 24/216, 217, 219, 220, 24/DIG. 29

[56] References Cited

U.S. PATENT DOCUMENTS

| | | | |
|---|---|---|---|
| 2,368,100 | 1/1945 | Boenecke | 24/216 |
| 3,613,181 | 10/1971 | Taylor | 24/216 |
| 4,268,101 | 5/1981 | Stone | 24/216 |

FOREIGN PATENT DOCUMENTS

| | | | |
|---|---|---|---|
| 16365 | of 1911 | United Kingdom | 24/216 |
| 542153 | 12/1941 | United Kingdom | 24/217 |
| 1073408 | 6/1967 | United Kingdom | 24/217 |

*Primary Examiner*—Gene Mancene

*Assistant Examiner*—John G. Weiss

*Attorney, Agent, or Firm*—Wenderoth, Lind & Ponack

[57] ABSTRACT

The invention provides an improved plastic socket component of the female snap of a snap fastener, which socket component is attached to one face of a flexible sheet such as the cloth of a garment by means of a rivent driven in from the other face of the flexible sheet and includes a cavity for coupling and uncoupling with a projection formed on a male snap. The cavity is surrounded by a thick peripheral wall having a plurality of relatively long arcuate embossments arranged at small intervals in the peripheral direction on an upper inner surface portion of the wall and a plurality of arcuate slits substantially equal in length to the embossments and arranged outwardly opposite thereto, the slits extending vertically through the peripheral wall. Adjacent pairs of the slits are interposed by thick wall portions having high rigidity. According to the improved construction, coupling and uncoupling between the projection of the male snap and the cavity of the female snap are carried out with a constant force regardless of the thickness of the flexible sheet, and do not get too tight temporarily after washing the flexible sheet.

3 Claims, 7 Drawing Figures

SOCKET COMPONENT FOR SNAP FASTENER

BACKGROUND OF THE INVENTION

1. Field of the Invention

This invention relates to a socket component for a female snap which, together with a male snap, constitutes a snap fastener, and more particularly to a plastic socket component having a cavity for coupling and uncoupling with a projection of the male snap and an opening defined centrally of a bottom wall of the cavity to receive a projection of a rivet driven in from one face of a flexible sheet to form a calking stop.

2. Description of the Prior Art

A known plastic socket component of the type described above is shown in FIG. 7. In this socket component 3' a cavity 10' is surrounded by a peripheral wall 13' having a substantial inverted U-shaped section and comprising an annular inner wall portion **13*a'* upstanding from the periphery of a bottom wall 11', an annular upper wall portion 13*b'* extending outwardly from the top of the inner wall portion 13*a'* and an annular outer wall portion 13*c'* depending from the outer edge of the upper wall portion 13*b'*. When coupling a projection 8' of the male snap and the cavity 10', the projection 8' is pushed into the cavity 10' elastically deforming the upper wall portion 13*b'*. When the projection 8' is seated in the cavity 10', the projection is cramped by the inner wall portion 13*a'* under the elastic restoring force of the upper wall portion 13*b'*. This plastic socket component 3'** has the following two advantages:

(1) A relatively board annular top surface S1 ' is defined by the upper wall portion **13*b'* around the opening end of the cavity 10'. Therefore, when the projection 8' of the male snap is to be inserted into the cavity 10', a peripheral portion of the projection 8' can be placed in contact with the annular top surface portion S1' and then guided into the cavity 10' by sliding over the annular top surface S1'. Thus positional adjustment between the projection 8' and the cavity 10'** is achieved with ease.

(2) After a projection **4*a'* of a rivet 4' driven in from one face of a flexible sheet 5*b'* penetrates through an opening 12' defining centrally of the bottom wall 11' of the socket component 3' and the leading end of the projection 4*a'* is crushed to form a calking stop, the flexible sheet 5*b'* is held not only between the undersurface of the bottom wall 11' and the back face of a head 4*b'* of the rivet 4' but also between the undersurface of the outer wall portion 13*c'* located around the bottom wall 11' and the back face of the head 4*b'* of the rivet 4' opposed thereto. Therefore, the socket component 3' is secured to the flexible sheet 5*b'*** in a reliable and stable manner.

However, the prior art construction described above has a disadvantage that the mating between the projection 8' and the cavity 10' becomes too loose or too tight depending on the thickness of the flexible sheet **5*b'***.

More particularly, where the flexible sheet **5*b'* comprises a thin material, the inner diameter at the opening end of the cavity 10' is maintained constant and therefore the projection 8' of the male snap can be fitted into the cavity 10' with a small force. On the other hand, where the flexible sheet 5*b'* comprises a thick material, the outer wall portion 13*c'* is pushed upward by the flexible sheet 5*b'* as seen in FIG. 7 when the flexible sheet 5*b'* is held between the undersurface of the outer wall portion 13*c'* and the back face of the head 4*b'* of the rivet 4'. The upper wall portion 13*b* ' then pushes the top of the inner wall portion 13*a'* toward the center of the cavity 10' reducing the inner diameter at the opening end of the cavity 10', which tends to result in difficulty in inserting the projection 8' of the male snap into the cavity 10'**.

Furthermore, since an annular groove a is defined between the inner wall portion **13*a'* and the outer wall portion 13*c'* with the upper wall portion 13*b'* forming its bottom, water tends to remain in the groove a after the garment carrying the snap fastener is washed. As a result, the plastic material in the inside faces of the annular groove a absorbs the water to get distended and reduce the inner diameter at the opening end of the cavity 10', whereby the coupling between the projection 8' and the cavity 10'** temporarily becomes too tight until the absorbed water fully dries up.

SUMMARY OF THE INVENTION

In view of the above state of the prior art, an object of the present invention is to provide a socket component for a snap fastener which eliminates the disadvantages of the prior art while retaining the advantages (1) and (2) noted hereinbefore, and more particularly to provide a socket component which couples and uncouples with the stud component with a constant force regardless of the thickness of the flexible sheet and hardly retains water after washing to avoid distension of the plastic material and temporary tightening of the coupling.

In order to achieve this object, a plastic socket component for a snap fastener according to this invention has a cavity for coupling and uncoupling with a projection of a stud component and an opening defined centrally of a bottom wall of the cavity to receive a projection of a rivet driven in from one face of a flexible sheet to form a calking stop, the socket component comprising a thick annular peripheral wall defining the cavity and including a plurality of relatively long arcuate embossments arranged peripherally on an upper inner surface portion of the peripheral wall, a plurality of arcuate slits substantially equal in length and arranged outwardly of and opposite to the arcuate embossments, respectively, the arcuate slits extending vertically through the peripheral wall, and thick wall portions of high rigidity disposed between respective adjacent pairs of the arcuate slits.

The construction of this invention having the above characteristic features produces the following functional effect. Since the peripheral wall of the cavity is in the form of a ring having a great material thickness, a plurality of relatively long arcuate embossments are provided in the peripheral direction on an upper inner surface portion of the peripheral wall, a plurality of arcuate slits substantially equal in length to the embossments are provided outwardly opposite to the respective embossments, and since thick material portions having good rigidity are formed between the slits, deformation of the upper portion of the peripheral wall toward the center of the cavity is prevented owing to the presence of the thick and rigid material portions which resist a force acting on the lower surface of the peripheral wall, may it be a strong force imparted by a thick flexible sheet held between the lower surface of the peripheral wall and the head of a rivet driven in from one side of the flexible sheet. Even if thin wall portions outwardly of the arcuate slits are deformed, the arcuate embossments are free from deformation since the embossments are shut away from the thin wall portions by the presence of the arcuate slits between the embossments and the thin wall portions.

The inner diameter at the opening end of the cavity is therefore not reduced but maintained constant even if the flexible sheet has a considerable thickness.

Furthermore, the arcuate embossments are readily subjected to elastic deformation at times of forcing the projection of the male snap into the cavity since the arcuate slits are provided outwardly of the embossments.

Coupling and uncoupling between the projection and the cavity are therefore effected with a uniform operational force regardless of the thickness of the flexible sheet.

Since the arcuate slits extend vertically through the peripheral wall, there will hardly be any residual water therein after washing the flexible sheet, which helps toward avoiding the inconvenience of plastic material in the inside faces of the arcuate slits becoming temporarily distended thereby to render the mating between the projection and the cavity too tight.

BRIEF DESCRIPTION OF THE DRAWINGS

In the drawings illustrating an embodiment of the present invention.

DESCRIPTION OF THE PREFERRED EMBODIMENT

An embodiment of the present invention is now described in detail with reference to the drawings.

Figure 1:
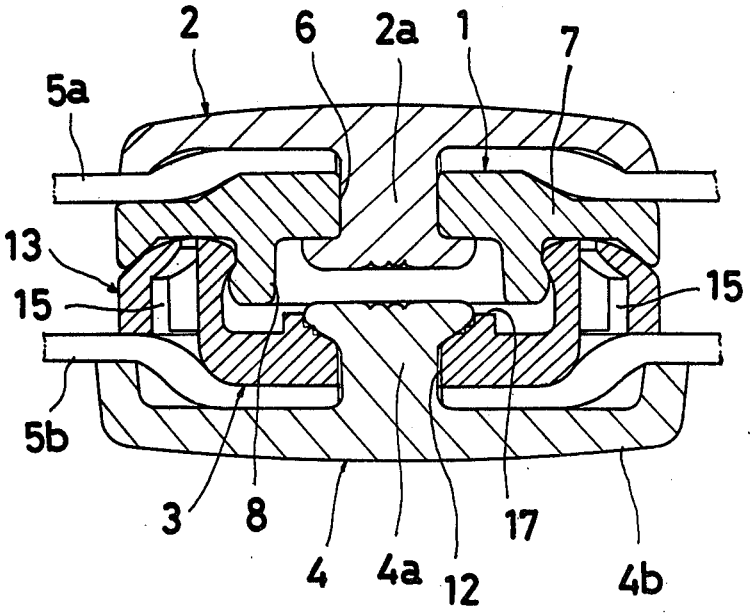
FIG. 1 is a view in vertical section of a snap fastener.

FIG. 1 shows a plastic snap fastener comprising a combination of a male snap and a female snap. The male snap includes a plastic stud component 1 and a plastic rivet 2, and the female snap includes a plastic socket component 3 and a plastic rivet 4. Reference 5*a* and 5*b* indicate flexible sheets such as material of a garment or a vinyl bag for packaging use.

Figure 2:
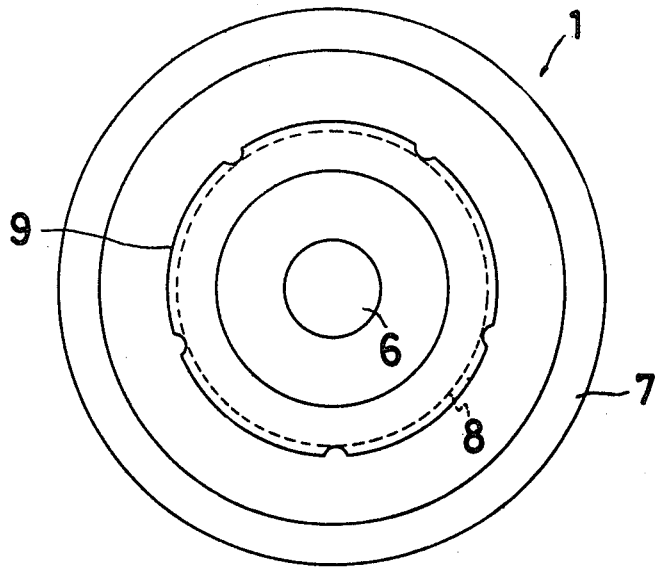
FIG. 2 is a bottom view of a stud component.

As shown in FIGS. 1 and 2, the stud component 1 comprises a base portion 7 defining a central opening 6 and an annular projection 8 extending from one face of the base portion 7. The opening 6 is penetrated by a projection 2*a* of the rivet 2 driven in from one face of the flexible sheet 5*a*, the leading end of the projection 2*a* being crushed into a flange to provide a calking stop. The annular projection 8 has a plurality of arcuate embossments 9 arranged at small intervals around the top outer periphery thereof.

Figure 3:
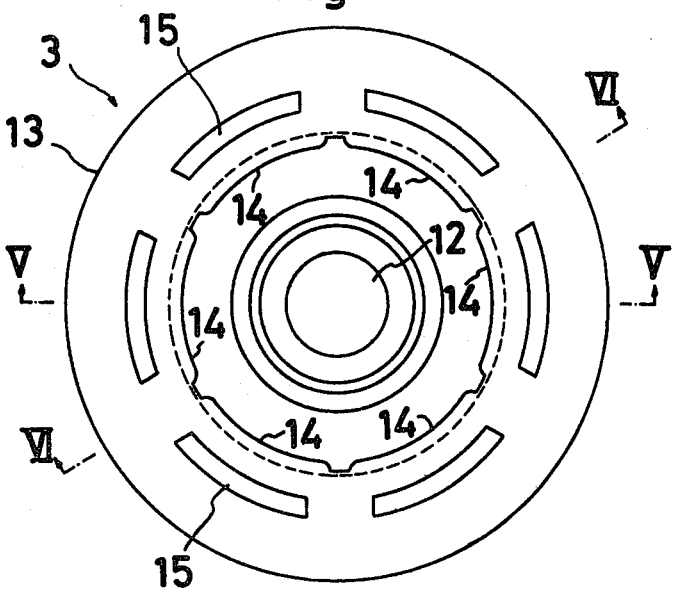
FIG. 3 is a plan view of a socket component.
Figure 4:
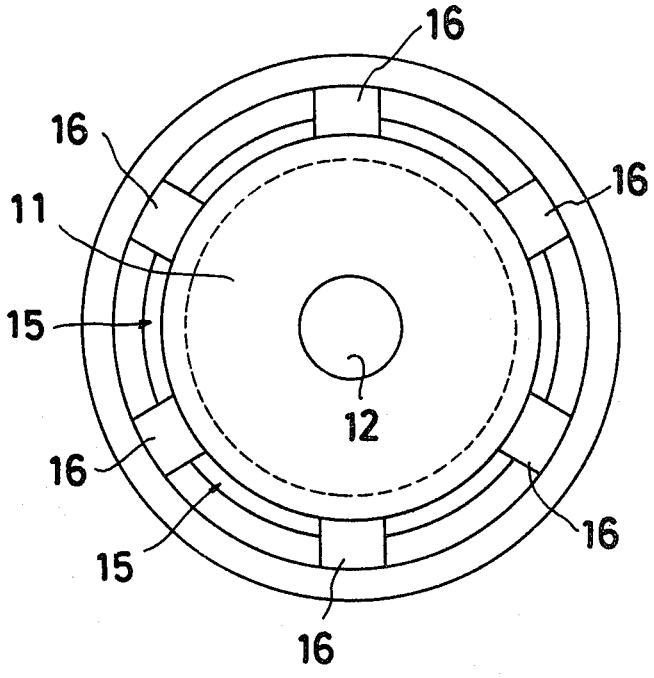
FIG. 4 is a bottom view of the socket component.
Figure 5:
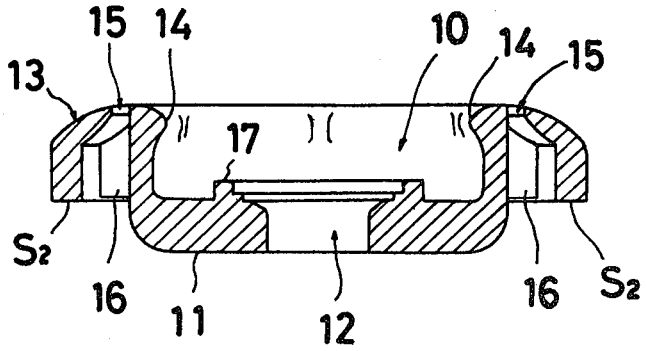
FIG. 5 is a sectional view taken on line V—V in FIG. 3.
Figure 6:
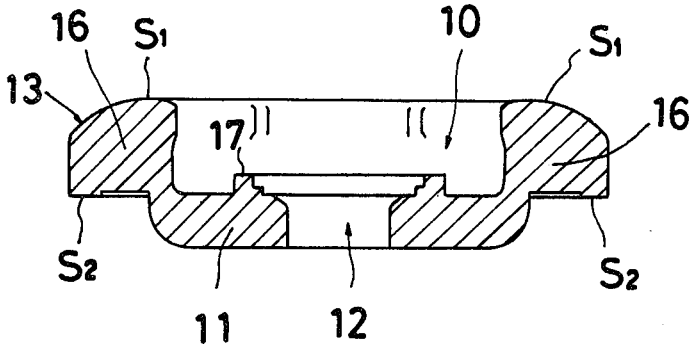
FIG. 6 is a sectional view taken on line VI—VI in FIG. 3.
Figure 7:
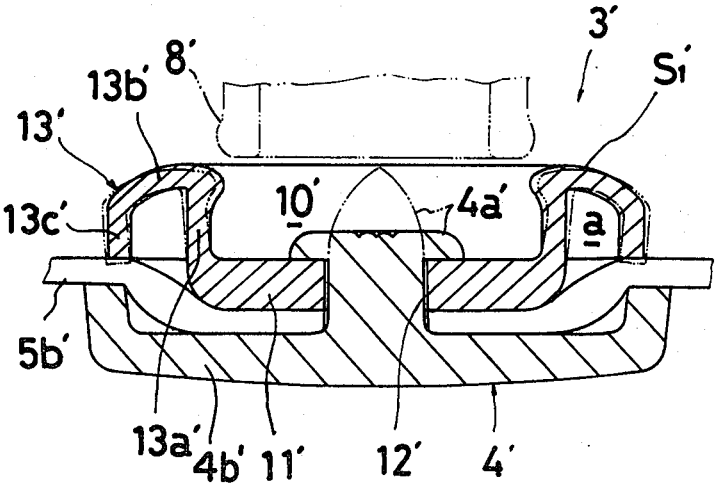
FIG. 7 is a view illustrating a prior art construction.

As shown in FIGS. 3 and 6, the socket component 3 includes a cavity 10 for coupling and uncoupling with the annular projection 8. An opening 12 is defined centrally of a bottom wall 11 of the cavity 10 to receive a projection 4*a* of the rivet 4 driven in from one face of the flexible sheet 5*b*, the leading end of the projection 4*a* being crushed into a flange to provide a calking stop.

The cavity 10 is surrounded by a thick peripheral wall 13 defining an annular upper surface S1 and an annular lower surface S2. The upper surface S1 is located around the opening end of the cavity 10 and comprises a planar portion and an inclined portion, the latter being disposed on the outer periphery of the planar portion and gently sloping downwardly as it extends outwardly. The lower surface S2 is located on the outer periphery of and slightly above an undersurface of the bottom wall 11 to press upon the flexible sheet 5*b*.

The peripheral wall 13 has a plurality of relatively long arcuate embossments 14 arranged at small intervals in the peripheral direction on an upper inner surface portion of the peripheral wall 13. The peripheral wall 13 also includes a plurality of arcuate slits 15 defined in radially intermediate positions of the material thickness of the wall 13 and extending vertically through the wall 13. It will be seen that the arcuate slits 15 are substantially equal in length to the arcuate embossments 14, and are positioned outwardly opposite to the respective embossments 14. Between adjacent pairs of the arcuate slits 15 are thick material portions 16 having good rigidity.

The top of each arcuate slit 15 is narrowed and opens at the planar portion of the upper surface S1. The bottom wall 11 has an annular upstanding wall 17 of smaller height than the peripheral wall 13, around the central opening 12. This upstanding wall 17 is provided in order to prevent entry to the cavity 10 of part of the flexible sheet 5*b* carried into the central opening 12 by the projection 4*a* of the pivot 4 as the projection 4*a* is driven through the flexible sheet 5*b*. More particularly, if part of the flexible sheet 5*b* is brought by the projection 4*a* into the central opening 12 in excessive amount when the rivet 4 is driven in from one face of the sheet 5*b*, the annular projection 8 of the male snap will abut against the part of the sheet 5*b* protruding into the cavity 10, which results in a shallow insertion of the annular projection 8 into the cavity 10 or an inclined seating of the male snap relative to the female snap thereby to hamper stable mating between the two snaps. The provision of the upstanding wall 17 is effective to avoid the above inconvenience.

The described construction, namely that the peripheral wall 13 of the cavity 10 is in the form of a ring having a great material thickness, the arcuate slits 15 are provided peripherally and outwardly of the arcuate embossments 9, and the thick material portions 16 having good rigidity are present between the respective adjacent pairs of the slits 15 has an advantage of positively preventing deformation of the upper portion of the peripheral wall toward the center of the cavity 10 when the flexible sheet 5*b* is held between the lower surface S2 of the peripheral wall 13 and the back face of the head of the rivet 4. The reason is that the rigid thick material portions 16 resist a force, which may be strong, acting on the lower surface S2 of the peripheral wall 13 when the sheet 5*b* is held thereunder. Even if thin wall portions outwardly of the arcuate slits 15 are deformed by the upcoming force from the flexible sheet 5*b*, the arcuate embossments 14 remain unaffected by the deformation of the thin wall portions owing to the presence of the arcuate slits 15. In other words, the arcuate embossments 14 are shut away from the thin wall portions by the slits 15.

The internal diameter at the opening end of the cavity 10 is therefore not reduced but maintained constant when the flexible sheet 5*b* is held between the lower surface S2 of the peripheral wall 13 and the back face of the head of the rivet 4 even if the sheet 5*b* has a considerable thickness. The arcuate embossments 14 are readily subjected to elastic deformation at times of forcing the annular projection 8 of the male snap into the cavity 10 since the internal diameter at the opening end of the cavity 10 is maintained constant and the arcuate slits 15 are provided outwardly of the embossments 14.

Coupling and uncoupling between the annular projection 8 and the cavity 10 are therefore effected with a uniform operational force regardless of the thickness of the flexible sheet 5*b*. Since the arcuate slits 15 extend vertically through the peripheral wall 13, there will hardly be any residual water therein after washing the flexible sheets 5*a* and 5*b*, which helps toward avoiding the inconvenience of plastic material in the inside faces of the arcuate slits 15 getting temporarily distended thereby to render the mating between the annular projection 8 and the cavity too tight.

The annular projection 8 may be provided with an annular embossment instead of the arcuate embossments 9. The male snap and the rivets may be formed of metal.

I claim:

1. A plastic socket component for a snap fastener, comprising:

a. a bottom wall having a centrally located opening for receiving a projection of a rivet of the snap fastener driven in from a face of a flexible sheet to form a calking stop; and b. a thick annular peripheral wall surrounding the periphery of said bottom wall to define a cavity for coupling with and uncoupling from a projection of a stud component of the snap fastener;

c. said annular peripheral wall having (1) an inner peripheral surface facing said cavity, (2) a plurality of relatively long arcuate embossments located peripherally at the upper end of said inner surface, (3) an outer peripheral surface radially outside said inner peripheral surface, (4) a lower surface, adjacent said outer peripheral surface, for abutting the flexible sheet such that the flexible sheet exerts an upward force on said lower surface proportional to the thickness of the flexible sheet, (5) a plurality of arcuate slits substantially equal in length and located respectively outwardly and radially aligned with said arcuate embossments and radially inwardly of said lower surface, and extending vertically entirely through said peripheral wall so as to define elastic wall portions between said slits and said outer peripheral surface which resiliently deform upon application of the upward force to said lower surface, and (6) thick wall portions extending continuously between said inner and outer peripheral surfaces, disposed between respective adjacent pairs of said arcuate slits and having sufficient rigidity so as not to bend in response to the upward force, to thereby maintain the radial diameters of said cavity independently of the thickness of the flexible sheet.

2. A socket component for a snap fastener as defined in claim 1 wherein said arcuate slits have upper ends narrower than lower ends.

3. A socket component for a snap fastener as defined in claim 1 further comprising an upstanding wall having a smaller height than said peripheral wall and disposed around said opening defined in the bottom wall of the cavity.

* * * * *